US012044236B2

(12) United States Patent
Dirauf et al.

(10) Patent No.: US 12,044,236 B2
(45) Date of Patent: Jul. 23, 2024

(54) FLUID PUMP

(71) Applicant: FTE automotive GmbH, Ebern (DE)

(72) Inventors: Markus Dirauf, Ebern (DE); Manuel Merkle, Ebern (DE); Sebastian Neubauer, Ebern (DE); Dominik Lawatsch, Ebern (DE); Thomas Pohl, Ebern (DE); Dimitri Ostrohov, Ebern (DE)

(73) Assignee: FTE automotive GmbH, Ebern (DE)

( * ) Notice: Subject to any disclaimer, the term of this patent is extended or adjusted under 35 U.S.C. 154(b) by 33 days.

(21) Appl. No.: 17/093,827

(22) Filed: Nov. 10, 2020

(65) Prior Publication Data

US 2021/0148379 A1 May 20, 2021

(30) Foreign Application Priority Data

Nov. 14, 2019 (DE) ..... 10 2019 130 723.6

(51) Int. Cl.
*F04C 15/00* (2006.01)
*F04C 11/00* (2006.01)

(52) U.S. Cl.
CPC ..... *F04C 15/0003* (2013.01); *F04C 11/008* (2013.01); *F04C 2240/30* (2013.01)

(58) Field of Classification Search
CPC ..... F04D 7/00; F04D 13/06; F04D 13/0606; F04D 29/00; F04D 29/08; F04D 29/086;
(Continued)

(56) References Cited

U.S. PATENT DOCUMENTS 5,639,228 A 6/1997 Van De Venne et al.
6,357,760 B1 * 3/2002 Doyle ..... F16L 17/08 277/612

(Continued)

FOREIGN PATENT DOCUMENTS

DE 100 59 059 A1 5/2002
DE 10 2012 207 078 A1 10/2013

(Continued)

OTHER PUBLICATIONS

Author: Amazon Title: Fleck 5600 Seal & Spacer Replacement Set Date published (mm/dd/yyyy): Jul. 10, 2013 Date accessed: Mar. 5, 2024 Link: https://www.amazon.com/Fleck-5600-Seal-Spacer-Replacement/dp/B00E1WOL5S (Year: 2013).*

(Continued)

*Primary Examiner* — Devon C Kramer
*Assistant Examiner* — Chirag Jariwala
(74) *Attorney, Agent, or Firm* — Oblon, McClelland, Maier & Neustadt, L.L.P.

(57) ABSTRACT

A fluid pump, in particular an oil pump, for supplying a clutch actuator, a gearbox actuator, a lubrication system, and/or a cooling system of a drive train, includes a pump unit, an electrical drive unit, and a one-piece sealing element. The pump unit is arranged in a first housing part of the fluid pump, and the electrical drive unit is arranged in a second housing part of the fluid pump. The one-piece sealing element seals the first housing part against the second housing part, and seals the first housing part against a housing cover arranged on a side opposite the second housing part. Furthermore, a method for producing such a fluid pump includes arranging a pump unit in a first housing part of the fluid pump and moulding a sealing element onto the first housing part.

16 Claims, 3 Drawing Sheets

Figure 1:
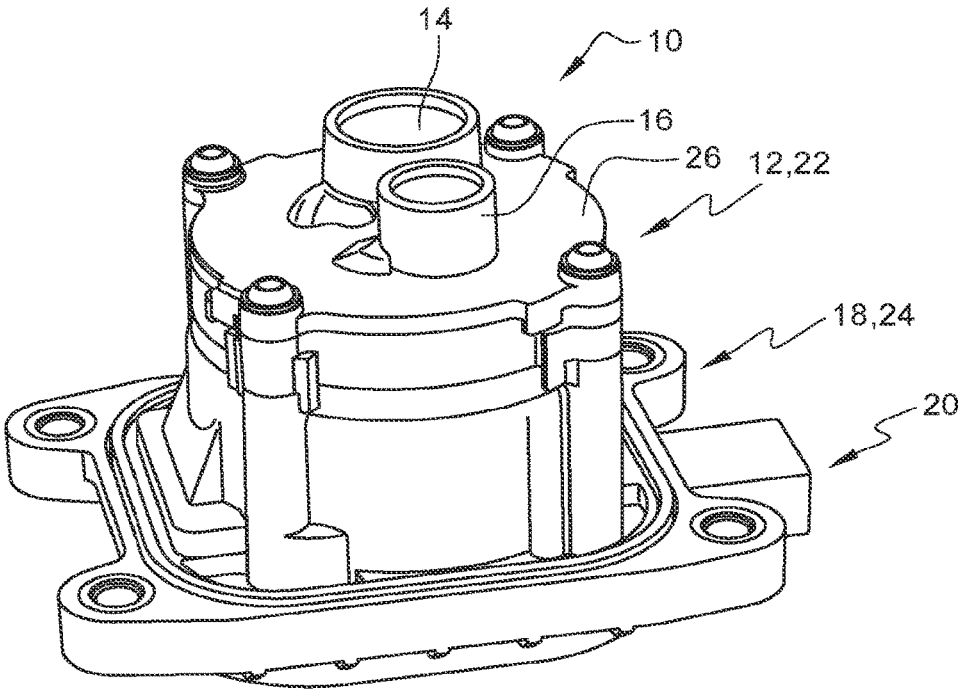

(58) Field of Classification Search
CPC ..... F04D 29/40; F04D 29/406; F04D 29/426; F04D 29/528; F04D 29/061; F04D 29/5806; F04C 15/0003; F04C 15/0019; F04C 15/0026; F04C 2210/14; F04C 2210/20; F04C 2210/206; F04C 11/008; F04C 15/0007; F04C 15/0023; F04C 2240/30; F16J 15/02; F16J 15/021; F16J 15/022; F16J 15/024; F16J 15/027
See application file for complete search history.

(56) References Cited

U.S. PATENT DOCUMENTS

2014/0377103 A1 12/2014 Høj et al.
2015/0030488 A1* 1/2015 Ebihara ..... F04C 2/10 418/61.3
2016/0377082 A1* 12/2016 Fecke et al. ..... H02K 11/25 417/420
2017/0009771 A1 1/2017 Reul et al.
2017/0082104 A1* 3/2017 Yamamoto ..... F04C 15/0096
2020/0248693 A1* 8/2020 Wahl ..... F04C 2/10

FOREIGN PATENT DOCUMENTS

EP 2 610 497 A1 7/2013
JP 2016-540156 A 12/2016

OTHER PUBLICATIONS

Extended European Search Report issued Dec. 10, 2020 in European Patent Application No. 20206094.3, 7 pages.
German Search Report issued Jul. 17, 2020 in German Application 10 2019 130 723.6 filed Nov. 14, 2019 (with English Translation of Categories of Cited Documents and Written Opinion), 6 pages.

* cited by examiner

FLUID PUMP

The invention concerns a fluid pump, in particular an oil pump for supply to a clutch actuator, a gearbox actuator, a lubrication system and/or a cooling system of a drive train, with a pump unit and an electrical drive unit.

In addition, the invention concerns a method for producing such a fluid pump.

Such fluid pumps and methods are known from the prior art. Fluid pumps are often fitted to motor vehicles, in particular cars.

Here, the fluid pumps must firstly function reliably in aggressive environments, i.e. environments with high temperatures and/or shaking or vibrations, over their entire useful life. In addition, the aim is always to produce fluid pumps as cheaply as possible. For this reason, the fluid pumps should be simple to produce. Often, ease of production of the fluid pump conflicts with reliable function over the entire useful life.

It is therefore an object of the invention to provide a fluid pump which resolves said conflict, i.e. is simple to produce and at the same time functions reliably over its entire useful life.

This object is achieved by a fluid pump of the type cited initially, in which the pump unit is arranged in a first housing part of the fluid pump, and the electrical drive unit is arranged in a second housing part of the fluid pump which is separate from the first housing part, wherein a one-piece sealing element is provided which seals the first housing part against the second housing part and seals the first housing part against a housing cover arranged on a side opposite the second housing part. Since the pump unit and electrical drive unit are arranged in separate housing parts, they may be preassembled initially with their assigned housing part. Then the two housing parts can be joined together. The housing cover here is also separate from the two housing parts. This allows rapid and simple assembly of the fluid pump. In this context, the one-piece sealing element means that the fluid pump as a whole is constructed from comparatively few components. It also simplifies assembly. The sealing element here fulfils substantially two sealing purposes. Accordingly, the first housing part is reliably sealed against the second housing part, and the first housing part is also reliably sealed against the housing cover. This ensures a long service life of the fluid pump. Advantageously, the housing part may be a thermoset plastic.

Also, a fluid inlet and/or a fluid outlet of the fluid pump may be provided on the housing cover. Thus the fluid inlet and fluid outlet lie on the same side of the fluid pump. The fluid pump may thus be mounted and connected even in constricted spaces.

According to one embodiment, the sealing element has a first annular sealing portion which is positioned between the first housing part and the second housing part, and in particular seals the first housing part against the second housing part.

Describing the sealing portion as "first" serves solely to designate it precisely. In particular, this term does not imply a number of sealing portions. The general shape of the annular sealing portion is oriented to the shape of the interface between the first housing part and the second housing part. In particular, the sealing portion has a circular ring shape. However, it may also substantially have the shape of an elliptical, rectangular or polygonal ring. The cross-section of the sealing portion should be distinguished from its shape. The cross-section may be circular or rectangular depending on the specific application. As a whole, the first annular sealing portion creates a reliable seal of the first housing part against the second housing part, which leads to a long service life of the fluid pump.

Alternatively or additionally, the sealing element has a second annular sealing portion which is positioned between the first housing part and the housing cover, and in particular seals the first housing part against the housing cover, in particular wherein the first sealing portion and the second sealing portion run substantially parallel to one another. Describing the sealing portion as "second" again serves solely to designate it precisely. In particular, this term does not imply a number of sealing portions. Otherwise, the effects and advantages which have already been explained with respect to the first sealing portion apply accordingly to the second sealing portion. The only difference is that the second sealing portion acts between the first housing part and the housing cover. A parallel course of the two sealing portions means that the two sealing portions are substantially congruent when viewed perpendicularly to a sealing plane spanned by the first sealing portion or the second sealing portion. Such a sealing element is particularly simple and compact in construction.

Advantageously, the sealing element has at least one connecting portion which connects the first sealing portion to the second sealing portion, in particular wherein the connecting portion extends substantially perpendicularly to the sealing planes defined by the first sealing portion and the second sealing portion. The connecting portion thus connects the first sealing portion and second sealing portion together integrally. The two sealing portions, more precisely the sealing plane defined by the first sealing portion and the sealing plane defined by the second sealing portion, may have a spacing of more than nil. The connecting portion thus allows the provision of a one-piece sealing element which acts in two sealing planes that are spaced apart from one another. This gives a good compromise between ease of production of the sealing element and the fluid pump, and a long service life of the latter which results in particular from a reliable seal in the sealing planes.

Also, several connecting portions may be arranged on the periphery of the annular sealing portions. The connecting portions may, but need not, be evenly distributed around the periphery. In particular, the two annular sealing portions are connected together via four to twelve connecting portions. Particularly preferably, six connecting portions are provided. The sealing element thus has a ladder-like form, wherein the two annular sealing portions should be regarded as the side bars and the connecting portions as the rungs.

With respect to the radial position of the connecting portions relative to the sealing portions, all connecting portions may lie substantially on a same radius. Alternatively, a first group of connecting portions may be further offset radially inwardly than a second group of connecting portions. In this way, the sealing element may be adapted to the geometric conditions inside the fluid pump.

The sealing element may comprise at least one, in particular two sealing lips pointing in the direction of the second housing part. The sealing lip is preferably provided integrally on the first sealing portion. In the case where two sealing lips are provided, in particular they run parallel. This gives a reliable seal of the first housing part against the second housing part.

Alternatively or additionally, the sealing element has at least one, in particular two sealing lips pointing in the direction of the housing cover. The sealing lip is preferably provided integrally on the second sealing portion. In the case where two sealing lips are provided, in particular they run parallel. This gives a reliable seal of the first housing part against the housing cover.

In a variant, the sealing element is made of an elastic mixture or a rubber mixture, in particular fluorocarbon rubber, in particular wherein the sealing element is injection-moulded into a space provided for this on the fluid pump. Elastic mixtures and rubber mixtures are materials with advantageous sealing properties which at the same time are easy to process. Also, by means of this material, durable sealing elements can be produced. This applies in particular to fluorocarbon rubber. By injection-moulding the sealing element into the space provided for this, a reliable sealing effect is achieved at the specified points. In addition, injection-moulding is a comparatively rapid production step. Furthermore, a sealing element may thus be provided in areas with difficult access.

The object is also achieved by a method of the type cited initially for production of a fluid pump, in which the pump unit is arranged in a first housing part of the fluid pump, wherein a sealing element for sealing the first housing part against a second housing part, which is separate from the first housing part and in which an electrical drive unit may be provided, and/or for sealing against a housing cover, is moulded onto the first housing part. By moulding the sealing element on, a component is produced comprising the first housing part and the sealing element. This component is designed so that it can be connected tightly to the second housing part and/or the housing cover. This moulding is simple and takes a comparatively short time. Accordingly, the fluid pump can be produced rapidly and easily.

In a variant, the moulding forms a first sealing portion of the sealing element which serves for sealing against the second housing part. Also, a second sealing portion of the sealing element is formed which serves for sealing against the housing cover. In other words, the sealing portions are formed during the moulding process. No further production steps are therefore required. The process for producing the fluid pump may thus take place particularly efficiently.

Preferably, the first sealing portion and the second sealing portion are arranged on opposite sides of the first housing part, in particular wherein the first sealing portion and the second sealing portion run substantially parallel. Thus fluid pumps may be produced in which the second housing part and the housing cover lie on opposite sides of the first housing part.

Advantageously, the sealing element is vulcanized after moulding. Thus an elastic behaviour is imposed on the sealing element which guarantees a reliable sealing effect. As an alternative, the sealing element as well as the thermoset plastic of the housing part are vulcanized in a common process step.

The method for production of a fluid pump is in particular designed to produce a fluid pump according to the invention.

Preferably, the sealing element is cohesively injection-moulded and/or is integral. This means that only a single injection-moulding process takes place without interruption. In other words, the sealing element is introduced "in one process". The associated production step can thus be performed comparatively quickly.

Also, the housing cover may be placed on the first housing part with sealing element moulded thereon, and/or the second housing part may be placed on the first housing part with sealing element moulded thereon. Thus the second housing part and/or the housing cover is/are mounted on the component consisting of the first housing part and the sealing element. The sealing effect provided by the sealing element is based in particular on the fact that the sealing element is compressed by application of the second housing part and/or the housing cover.

Figure 2:
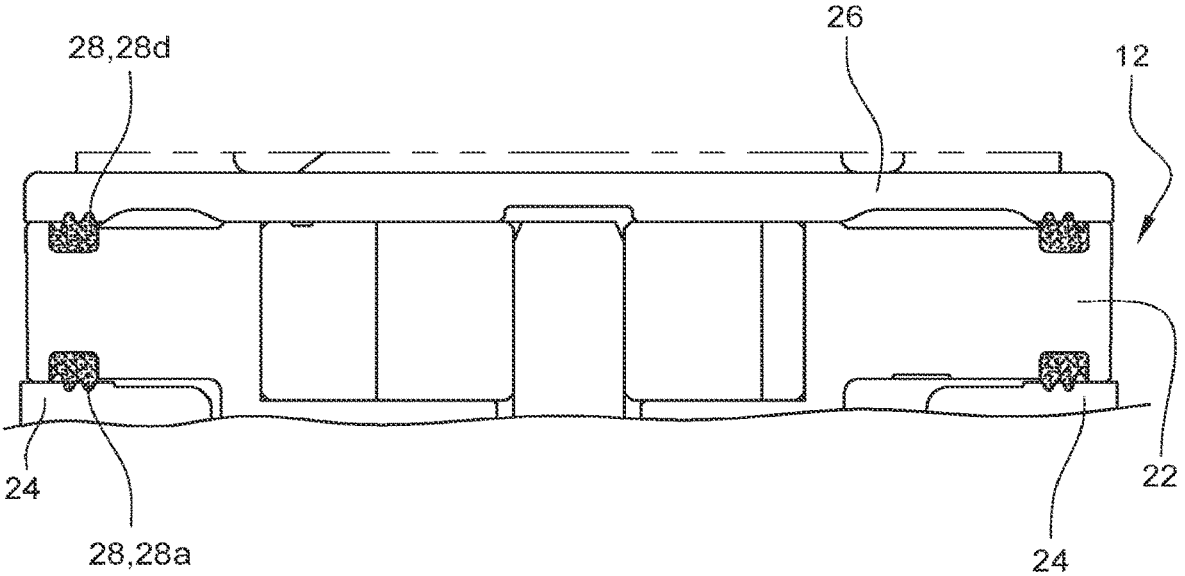
Figure 3:
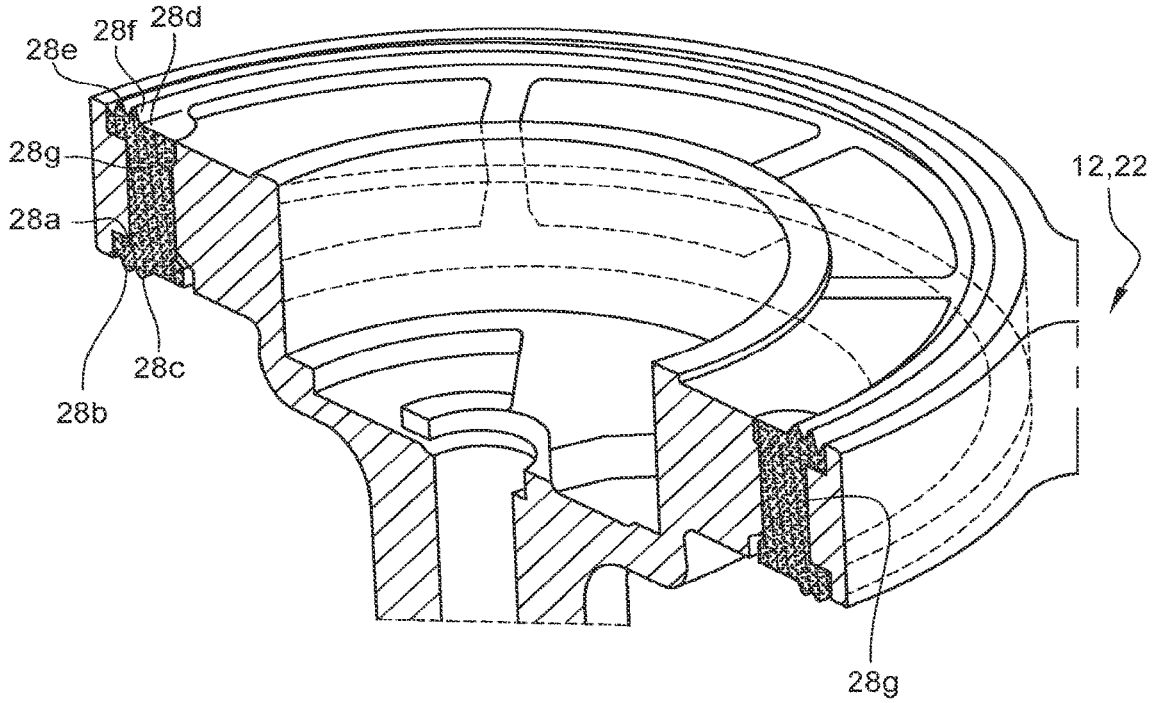
Figure 4:
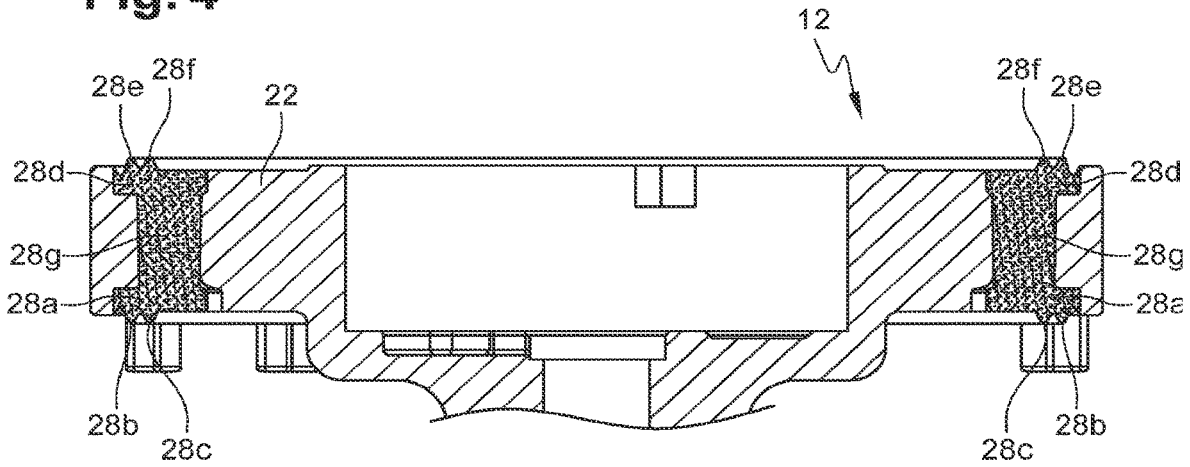
Figure 5:
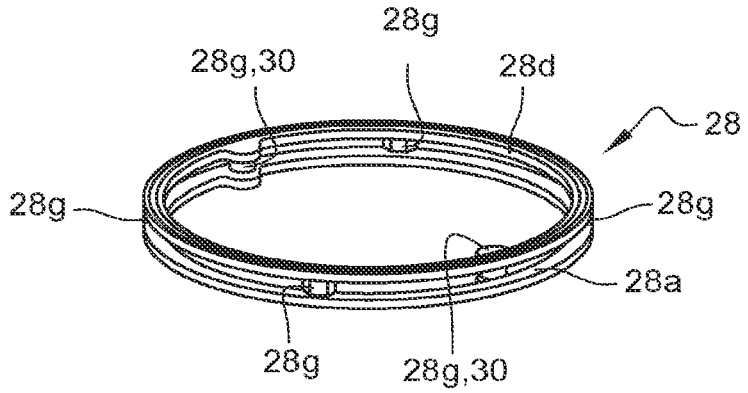
Figure 6:
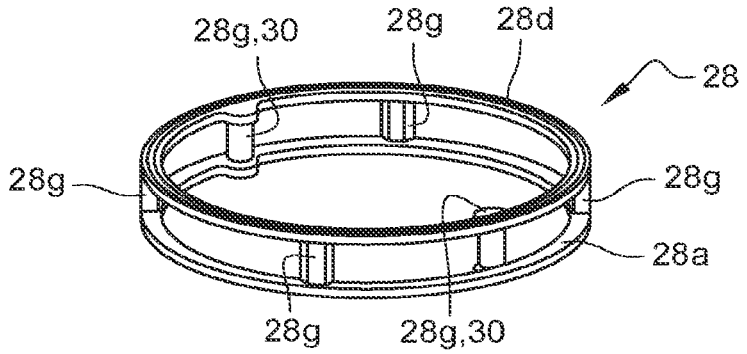
Figure 7:
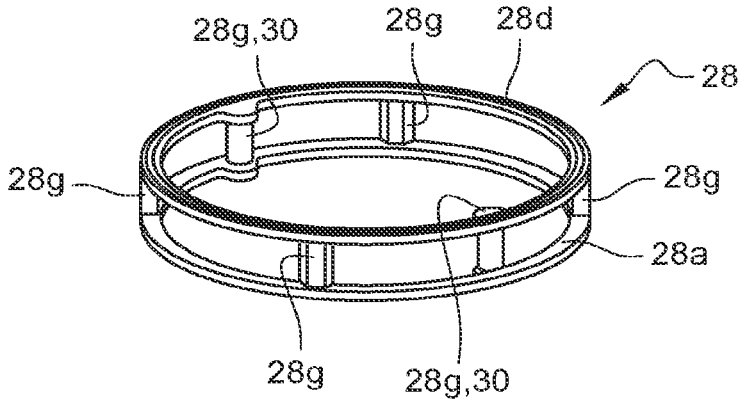
Figure 8:
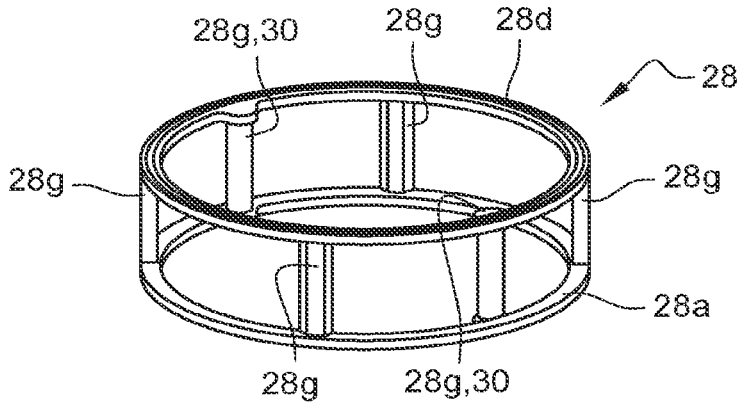

The invention is explained below with reference to various exemplary embodiments shown in the attached drawings. The drawings show:

FIG. 1 a fluid pump according to the invention which is produced by means of a method according to the invention, in a perspective external view, FIG. 2 a longitudinal section through a part of the fluid pump from FIG. 1 in a side view, FIG. 3 a further longitudinal section through a part of the fluid pump from FIG. 1 in a perspective depiction, wherein parts of a pump unit have been omitted, FIG. 4 a side view of the illustration from FIG. 3, and FIG. 5 to FIG. 8 different variants of a sealing element of the fluid pump from FIGS. 1 to 4.

FIG. 1 shows a fluid pump 10 which, in the embodiment shown, is formed as an oil pump for supplying a clutch actuator.

At the same time, the fluid pump 10 is also suitable for supplying oil to a gearbox actuator, a cooling system and/or a lubrication system of a drive train.

The fluid pump 10 is designed as an annular gear pump. It thus comprises a pump unit 12 which works on the principle of an annular gear pump.

By means of the pump unit 12, fluid provided to the fluid pump 10 via a fluid inlet 14 is conveyed to a fluid outlet 16 of the fluid pump 10. The fluid is pressurised, so the fluid inlet 14 may be described as the suction side and the fluid outlet 16 as the pressure side.

The pump unit 12 is driven by means of an electric drive unit 18 which is controlled by a control unit 20.

The pump unit 12 is here received in a first housing part 22 of the fluid pump, and the electrical drive unit 18 in a second housing part 24.

The first housing part 22 and the second housing part 24 are separate components which are mounted on each other during production of the fluid pump 10.

The fluid inlet 14 and the fluid outlet 16 are provided in a housing cover 26. This is another component which is separate from the first housing part 22 and second housing part 24. The housing cover 26 is thus also mounted on the first housing part 22 during production of the fluid pump.

The fluid pump 10 is also equipped with a one-piece sealing element 28.

This has a first annular sealing portion 28*a*, which is positioned between the first housing part 22 and the second housing part 24 and in particular seals the first housing part 22 against the second housing part 24.

For this, a total of two sealing lips 28*b*, 28*b*, pointing in the direction of the second housing part 24, are provided on the first annular sealing portion 28*a*.

The one-piece sealing element 28 furthermore has a second annular sealing portion 28*d*, which is positioned between the first housing part 22 and the housing cover 26 and in particular seals the first housing part 22 against the housing cover 26.

The first annular sealing portion 28*a* and the second annular sealing portion 28*d* run substantially parallel to one another.

Also, a total of two sealing lips 28*e*, 28*f*, pointing in the direction of the housing cover 26, are provided on the second annular sealing portion 28*d* and serve for sealing the first housing part 22 against the housing cover 26.

The two sealing portions 28*a*, 28*d* are furthermore connected together via several connecting portions 28*g*.

The connecting portions 28*g* extend substantially perpendicularly to the sealing planes defined by the first sealing portion 28*a* and the second sealing portion 28*d*.

FIGS. 5 to 8 show a non-definitive number of variants of the one-piece sealing element 28.

From these examples, it is evident firstly that a distance between the first annular sealing portion 28*a* and the second annual sealing portion 28*d* may be set via a length of the connecting portions 28*g*.

Secondly, it is clear from the examples of FIGS. 5 to 8 that the radial positions of the connecting portions 28*g* on the annular sealing portions 28*a*, 28*d* may differ.

In this context, for example the connecting portions 28*g* which also carry reference sign 30 are offset radially inwardly relative to the other connecting portions 28*g*.

In all variants, the one-piece sealing element 28 is made of fluorocarbon rubber.

The sealing element 28 is moulded onto the first housing part 22 during production of the fluid pump 10.

During the moulding, the first sealing portion 28*a* and the second sealing portion 28*d* are also formed. The sealing portions 28*a*, 28*d* are arranged on opposite sides of the first housing part 22.

The sealing element 28 is preferably cohesively and integrally moulded onto the first housing part 22, i.e. the moulding takes place in one process.

The sealing element 28 is then vulcanized. This gives it elastic properties.

This results in a component which comprises the first housing part 22 and the sealing element 28.

Both the second housing part 24 and the housing cover 26 are placed on this component at the respective assigned opposite sides. Thus the sealing element 28, or more precisely the sealing portions 28*a*, 28*d*, is compressed so as to create a reliable seal of the first housing part 22 against the second housing part 24 and against the housing cover 26.

The invention claimed is:

1. A fluid pump for supplying a fluid to at least one of a clutch actuator, a gearbox actuator, a lubrication system, and a cooling system of a drive train, comprising:

a pump unit;

an electrical drive unit; and a one-piece sealing element, wherein the pump unit is an annular gear pump and is arranged in a first housing part of the fluid pump, the electrical drive unit is arranged in a second housing part of the fluid pump which is separate from the first housing part, the one-piece sealing element seals the first housing part against the second housing part and seals the first housing part against a housing cover arranged on a side opposite the second housing part, the one-piece sealing element has a first annular sealing portion, which is positioned between the first housing part and the second housing part and seals the first housing part against the second housing part, the one-piece sealing element has a second annular sealing portion, which is separate from the first annular sealing portion, is positioned between the first housing part and the housing cover, and seals the first housing part against the housing cover, and the first annular sealing portion and the second annular sealing portion are connected together via several connecting portions.

2. The fluid pump according to claim 1, comprising:

at least one of a fluid inlet and a fluid outlet of the fluid pump provided on the housing cover.

3. The fluid pump according to claim 1, wherein the first annular sealing portion and the second annular sealing portion run substantially parallel to one another.

4. The fluid pump according to claim 3, wherein the connecting portions extend substantially perpendicularly to sealing planes defined by the first annular sealing portion and the second annular sealing portion.

5. The fluid pump according to claim 4, wherein a distance between the first annular sealing portion and the second annular sealing portion is equal to a length of each of the connecting portions.

6. The fluid pump according to claim 1, wherein the one-piece sealing element has at least one sealing lip pointing in a direction of the second housing part.

7. The fluid pump according to claim 1, wherein the one-piece sealing element has at least one sealing lip pointing in a direction of the housing cover.

8. The fluid pump according to claim 1, wherein at least the one-piece sealing element is made of an elastic mixture, and the one-piece sealing element is injection-moulded into a space on the first housing part.

9. The fluid pump according to claim 1, wherein the fluid pump is an oil pump.

10. The fluid pump according to claim 1, wherein the one-piece sealing element has two sealing lips pointing in a direction of the second housing part.

11. The fluid pump according to claim 1, wherein the one-piece sealing element has two sealing lips pointing in a direction of the housing cover.

12. The fluid pump according to claim 1, wherein at least one of:

the one-piece sealing element is made of a rubber mixture, and the one-piece sealing element is injection-moulded into a space on the first housing part.

13. The fluid pump according to claim 1, wherein at least one of:

the one-piece sealing element is made of a fluorocarbon rubber, and the one-piece sealing element is injection-moulded into a space on the first housing part.

14. The fluid pump according to claim 1, wherein the first housing part is mounted separately on the second housing part.

15. The fluid pump according to claim 1, wherein the first annular sealing portion is positioned between the first housing part and the second housing part and configured to separate the first housing part and the second housing part.

16. The fluid pump according to claim 1, wherein the connecting, portions are not evenly distributed.

* * * * *